US005563692A

United States Patent [19]

Cho

[11] Patent Number: 5,563,692

[45] Date of Patent: Oct. 8, 1996

[54] AUTOMATIC APPARATUS AND METHOD FOR CLEANING A CHARGE LINE

[75] Inventor: Jung Sik Cho, Kyeongki-do, Rep. of Korea

[73] Assignee: Hyundai Electronics Ind. Co., Ltd., Kyeongki-do, Rep. of Korea

[21] Appl. No.: 164,006

[22] Filed: Dec. 8, 1993

[30] Foreign Application Priority Data

Dec. 10, 1992 [KR] Rep. of Korea ..... 1992-23880

[51] Int. Cl.[6] ..... G03G 15/16

[52] U.S. Cl. ..... 355/274; 250/324; 355/215; 355/219; 355/271

[58] Field of Search ..... 355/215, 219, 355/221, 271, 273, 274, 77; 250/324, 325, 326; 361/225, 230

[56] References Cited

U.S. PATENT DOCUMENTS

| | | | |
|---|---|---|---|
| 4,788,573 | 11/1988 | Nakaoka et al. | 250/324 X |
| 4,811,050 | 3/1989 | Tanjo et al. . | |
| 4,885,466 | 12/1989 | Koichi et al. | 250/324 |
| 4,924,268 | 5/1990 | Ogura | 355/219 |
| 4,956,671 | 9/1990 | Otsuka | 355/215 |
| 5,023,748 | 6/1991 | Okamoto et al. | 361/229 |
| 5,170,314 | 12/1992 | Saito | 361/212 |
| 5,194,897 | 3/1993 | Yoshiyama et al. | 355/215 |
| 5,250,991 | 10/1993 | Ikeda | 355/215 |

*Primary Examiner*—Sandra L. Brase
*Attorney, Agent, or Firm*—Wenderoth, Lind & Ponack

[57] ABSTRACT

A method and apparatus for cleaning the charge line of the transfer charger before copying process in an electrostatic apparatus. The cleaning apparatus comprises cleaning member, such as brush, light-blocking plate, driving motor, a pair of pulleys, wire, positon sensors and control member. Motor driving program is recorded on the the controller for applying power and cleaning the charge line automatically, whereby a dim or unclear image does not appear on copy sheets.

5 Claims, 3 Drawing Sheets

AUTOMATIC APPARATUS AND METHOD FOR CLEANING A CHARGE LINE

BACKGROUND OF THE INVENTION

This invention relates to an electrostatic apparatus and more particularly to an improved apparatus for cleaning a charge line of a transfer charger for use in an electrostatic apparatus.

The performance of electrostatic apparatuses, such as copying machines or laser beam printers depends on a clearness degree of the developed images on copy sheets. Typically, a substantial high voltage is applied to charge line to transfer the toner from a photosensitive drum to the copy sheets, and the quality of images on the copy sheets are greatly affected by the charges from a charge line of a transfer charger.

A typical transfer process is described with reference to FIG. 1. A first charger 32 and a transfer charger 33 both of which have charge fines are respectively provided above and below a photosensitive drum 31. A developer 34 and a drum cleaner 35 are provided at opposite sides of the drum 31.

In operation, the photosensitive drum 31 is rotated above the transfer charger 33, and copy sheets pass over the transfer charger 33. The residual toner remaining on the drum 31 is removed by the drum cleaner 35.

In the typical electrostatic machine, the charge line is likely to be contaminated due to the residual toner scattered on the drum 31 or the dust on the copy sheets or in atmosphere.

A substantial high voltage is applied to a charge line of the transfer charger 33 to transfer the toner from the drum 31 to the copy sheets. The contamination of some or all of the charge line causes production of uneven or dim images, or of no images on copy sheets.

For preventing such phenomenon, a manual on the typical electrostatic machine instructs users to periodically brush off the transfer charger and the charge line. This is cumbersome and most users are inclined to ignore the instructions. Furthermore, it is particularly difficult to periodically brush off the charger and charge line in offices where lots of people use the machine. Generally, most people are liable to assume that the trouble is in the transfer charger and thereby raise a question about the quality of the machine and require a service technician to inspect the machine.

SUMMARY OF THE INVENTION

An object of the present invention is to provide a method and an apparatus for automatically cleaning a charge line of a transfer charger in an electrostatic apparatus which overcomes the above-noted deficiences.

A cleaning apparatus according to this invention comprises a pair of pulleys connected to a motor through a pulley gear for mounting and moving a wire thereover, a cleaning member fixed to the upper part of the wire, a light-blocking member fixed to the lower part of the wire, the cleaning member and the light-blocking member disposed in cross relationship with respect to each other, a home and a back position sensors mounted at opposite lower ends of the transfer charger, and a controller connected electrically to a driving motor and the sensors for sensing signals from the sensors and rotating the driving motor clockwise or counterclockwise.

DETAILED DESCRIPTION OF THE INVENTION

Figure 1:
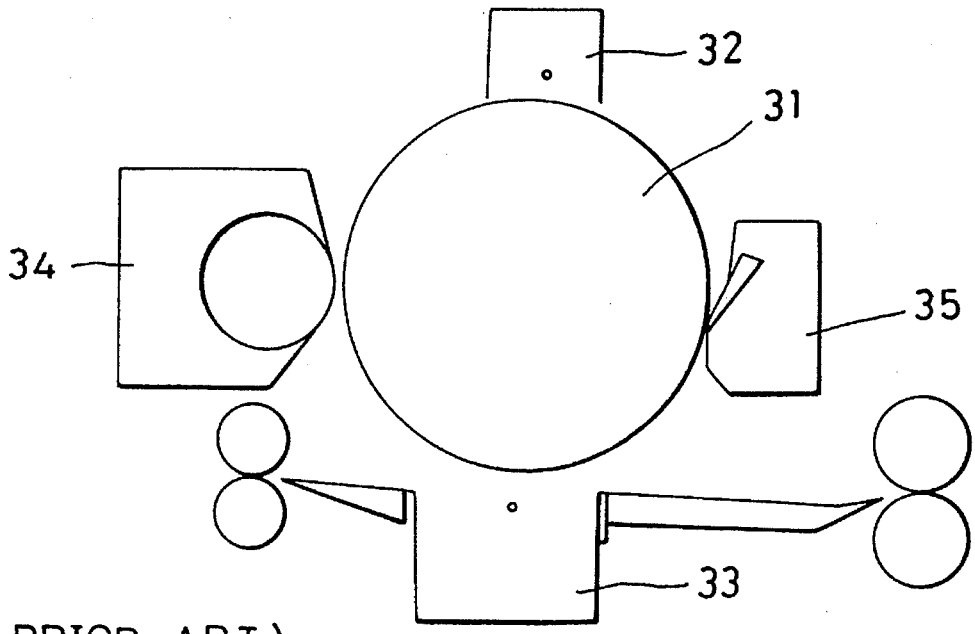
FIG. 1 is a schematic side view of a transfer charger in a typical electrostatic machine.
Figure 2:
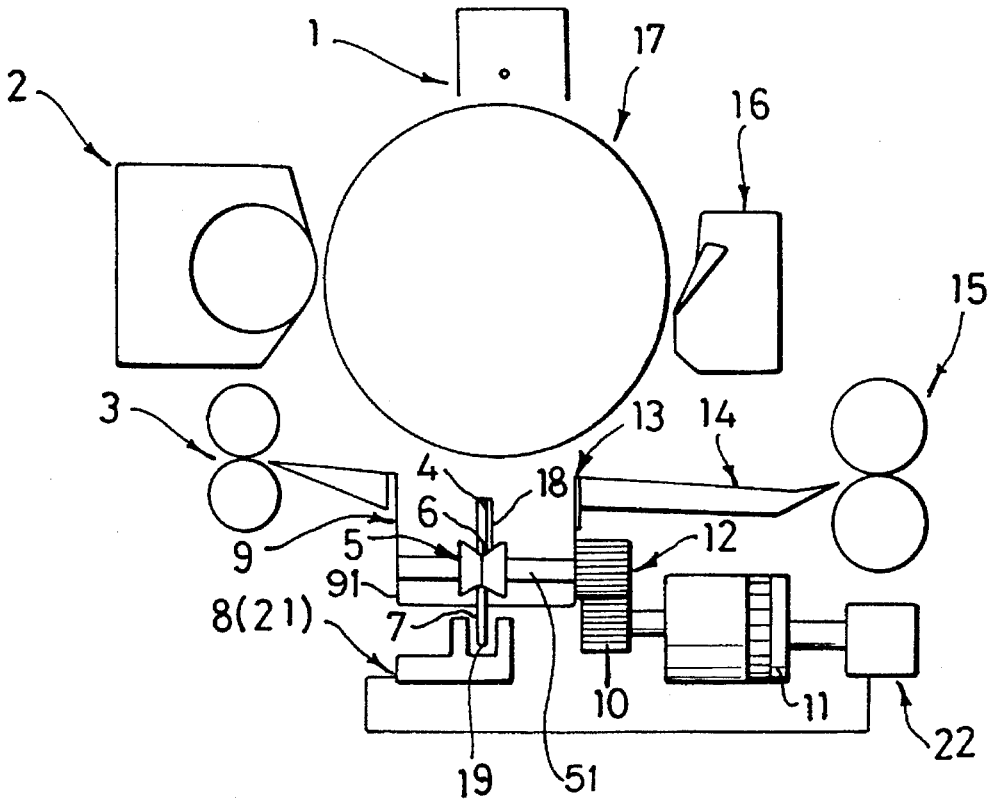
(PRIOR ART) Fig. 2
FIG. 2 is a schematic side view of a transfer charger provided with a cleaning apparatus of the present invention.
Figure 3A:
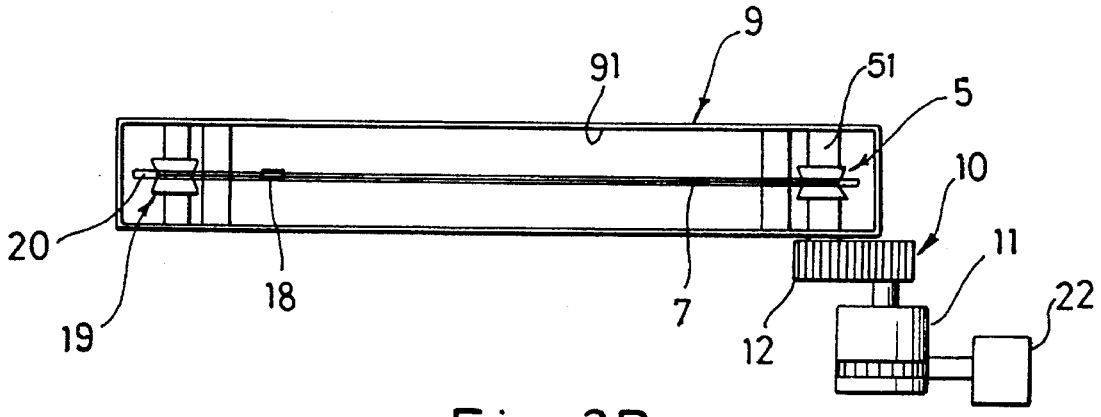
FIG. 3A is a top plan view of the transfer charger assembled with the cleaning apparatus of the present invention.
Figure 3B:
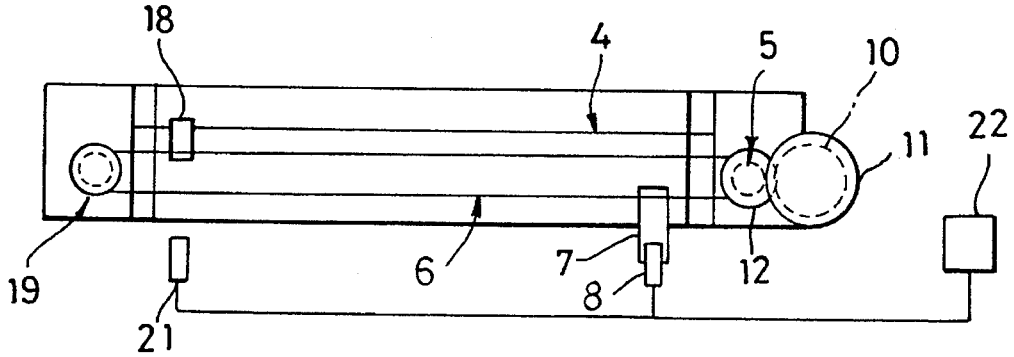
FIG. 3B is a front view of FIG. 3A.

Referring jointly to FIGS. 2, 3A and 3B, an electrophotographic machine according to the teachings of the invention comprises a photosensitive drum 17, a first charger 1, a drum cleaning member 16 and a developing member 2.

A transfer charger 9 having a charge line 4 is mounted below the photosensitive drum 17. A pair of register rollers 3 are disposed at the entry side of copy sheets, and a sheet carrying member-14, an anti-electrostatic rod 13 and a pair of fixing rollers 15 are disposed at the discharge side of copy sheets.

The transfer charger 9 is provided with an automatic charge line cleaning device of the present invention and has approximately oblong, one-side opened casing 91. A guide slit 20 of a larger length than charge line 4 extends lengthwise along the bottom of the casing 91. A pair of pulleys 5 are mounted at the opposite sides within the casing 91 for moving a cleaning member 18 and a fight-blocking plate 7 along the charge line 4.

The pair of pulleys 5 are mounted directly above and extend across the guide slit 20. Each pulley 5 is mounted for rotation on a boss 51 which is fixed between the front and rear face of the casing 91 by a fining means (not shown) which is inserted through the sides of the casing 91.

It is preferable that the pulleys 5 rotate below the charge line 4 and the distance between the pulleys 5 is larger than length of the charge line 4. For providing safety in rotation, it is preferable that the pulleys 5 have grooved periphery.

One of the bosses 51 extends through the front face of the casing 91 for mounting thereon a driving pulley gear 12 which engages a driving gear 10 mounted on a shaft of a driving motor 11. A wire 6 passes over the pair of pulleys 5.

As the wire 6, a handy, thin wire having good shearing force, waterproof property and wear resistance, such as piano wire, fishline or the like may be used.

As shown in FIG. 3B, a cleaning member 18, such as a brush is fixed to the upper part of the wire 6 at its lower end. A light-blocking plate 7 is fixed to the lower part of the wire 6 in diagonal relationship with respect to the cleaning member 18. With this arrangement, the light-blocking plate 7 is moved simultaneously with the cleaning member 18 for blocking light from a home position sensor 21 and a back position sensor 8 which sense the location of the cleaning member 18.

Figure 4A:
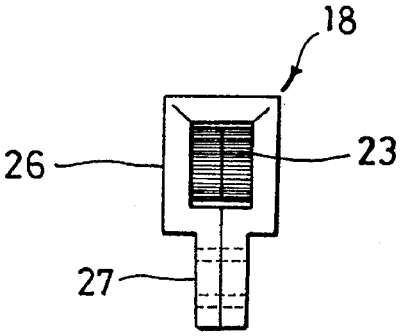
FIG. 4A is a front view of a cleaning member of the cleaning apparatus of the present invention, in folded position.
Figure 4B:
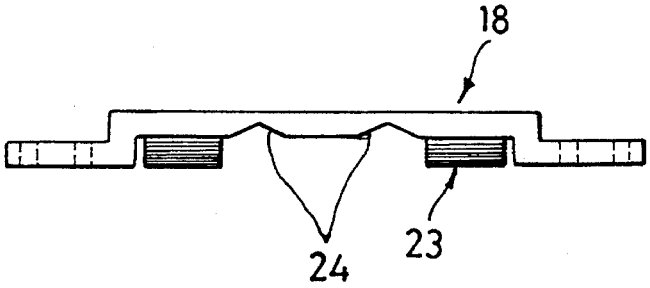
FIG. 4B is a front view of a cleaning member in unfolded position.

The cleaning member 18 is of a structure which can be folded so as to, wrap around and brush off the charging line 4. For this purpose, as shown in FIG. 4B, the cleaning member 18 has a first section 2,6, foldable recesses 24 formed in its upper, inner surface, cleaning pads 23 fixed to its inner face, and a second section 27. The second section 27 is fixed to the lower part of the wire 6 by fastening means (not shown).

A controller 22 is connected to a terminal of the driving motor 11. The home position sensor 21 is disposed at a location where the movement of the cleaning member 18 begins and the back position sensor 8 is disposed at a location where the movement of the cleaning member 18 ends.

A sensor groove 19 is provided directly below and in alignment with the guide slit 20, and extends lengthwise for guiding the movement of the light-blocking plate 7.

Figure 5:
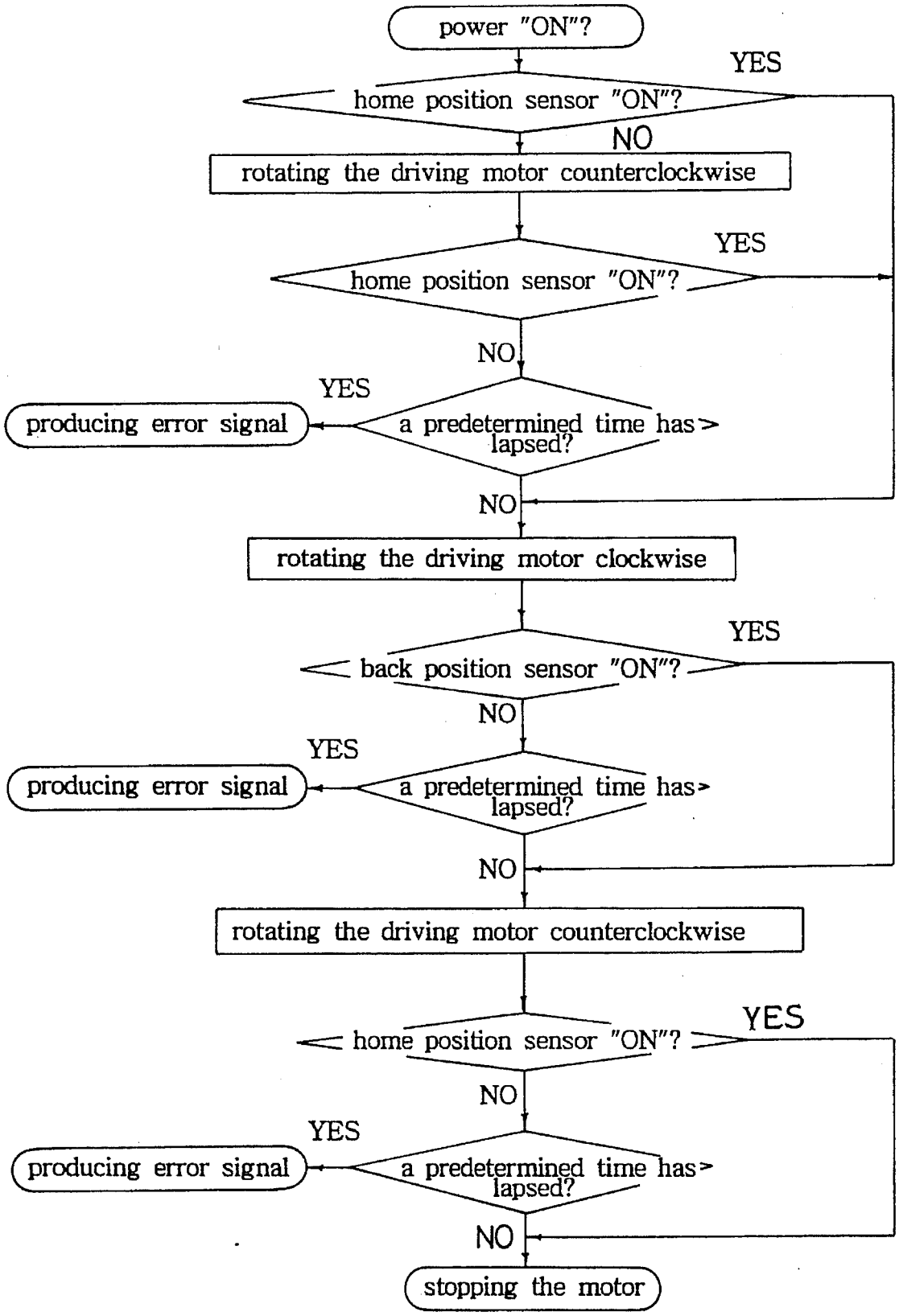
FIG. 5 is a flow chart showing art automatic cleaning method of the present invention.

As shown in FIG. 5, with power on, the controller 22 detects whether the home position sensor 21 is on. Detection of the off state of the home position sensor 21 will cause the driving motor 11 to rotate counterclockwise until the home position sensor 21 is on, while detection of the on state of the home position sensor 21 will cause the driving motor 11 to rotate clockwise until the back position sensor 8 is on. When the back position sensor 8 is on, the driving motor 11 will rotate counterclockwise until the home position sensor 21 is on and will stop.

An error message is produced when a predetermined time lapses but one of the sensors 21 or 8 is not on, after the other sensor is on.

The operation and effect of the charge line cleaning apparatus of the present invention is detailed below.

When an electrostatic machine is on, the controller 22 checks the home position sensor and back position sensor 21 and 8, and detects the location of the cleaning member 18.

When the cleaning member 18 is above the home position sensor 21, the home position sensor 21 is on and the back position sensor 8 is off. When the cleaning member 18 is above the home position sensor 21, an electric signal of the controller 22 will cause the driving motor 11 to rotate clockwise.

The clockwise rotation force is transmitted to the pulleys 5 through the driving gear 10 and the driving pulley gear 12, thus moving the wire 10 in the rotation direction of the pulleys 5.

The cleaning member 18 slides along the charge line 4, and the light-blocking plate 7 moves from the home position sensor 21 to the back position sensor 8. When the light-blocking plate 7 reaches one position of the sensor groove 19 adjacent to the back position sensor 8, light is blocked causing the back position sensor 8 to be on, thereby rotating the driving motor 11 and the driving gear 10 counterclockwise.

Rotation of the driving gear 10 counterclockwise will cause the wire 6 to move in a predetermined direction, thereby moving the light-blocking plate 7 from the back position sensor 8 to the home position sensor 21 in the sensor groove 19, whereby the cleaning member 18 slides along the charge line 4.

The movement of the light-bloc king plate 7 to the beginning location, i.e., to the home position sensor 21 for blocking light will cause the controller 22 to cut off the power to the driving motor 11, thereby stopping the driving motor 11. With one receiprocation of the wire 6, the cleaning member 18 brushes up the charge line.

With power on when the cleaning member 18 is in alignment with the back position sensor 8, and between the back and home position sensors, either the back positon sensor is on or no sensors are on. The controller 22 detects such condition and rotates the stopped driving motor 11 counterclockwise by applying an electric signal to the stopped driving motor. When the light-blocking plate 7 is completely inserted in the sensor groove 19 adjacent to the home position sensor 21, the home position sensor is on, which is detected by the controller 22. The controller 22 then stop the, driving motor 11.

In the controller 22, a standard, predetermined time required for moving the light-blocking plate 7 from the home position sensor 21 to the back position sensor 8 is recorded such that, when the light-blocking member 7 moves from the back position sensor to the home position sensor and a counterpart sensor does not turn on even after the standard, predetermined time lapsed, an error message is displayed on the display panel of the cabinet of an electrostatic machine.

Other modifications and variations may be made to the disclosed embodiments without departing from the scope of the invention as defined in the following claims.

What is claimed is:

1. An apparatus for cleaning a charge line of a transfer charger for use in an electrostatic machine comprising, a photosensitive drum, a first charger above the drum for charging the drum, transfer charger provided below the drum including said charge line having a home end and an opposite end, said transfer charger also having a casing having one side open toward said drum, a developer for supplying toner on the photosensitive drum and forming an image on the drum, a drum cleaning member for removing the residual toner on the drum, a pair of register rollers for carrying the copy sheets onto the transfer charger, an anti-electrostatic rod for removing the residual charges on the transferred copy sheets to a pair of fixing rollers, said apparatus for cleaning comprising:

a guide slit extending lengthwise along the bottom of the casing of the transfer charger;

a light blocking member;

a cleaning member which folds over and completely envelopes said charge line;

a drive motor for moving said cleaning member along said charge line;

controller logic for controlling operation of said drive motor;

a pair of pulleys mounted for rotation at opposite ends within the transfer charger casing and having an wire or drive belt passing thereover, each pulley extending across the guide slit, the wire or drive belt passing over and around the pair of pulleys so as to form a loop having a top portion adjacent and parallel to said charge line and a bottom portion on the opposite side of said pulleys from said top portion said wire or drive belt being affixed to said light-blocking member and to said cleaning member for moving said cleaning member and said light-blocking member with said wire or belt when said pulleys are rotated, the distance between the pair of pulleys being longer than the length of said charge line, said light-blocking member being attached to said bottom portion of said wire or belt and the cleaning member being attached to said top portion of said wire or belt;

a sensor groove provided adjacent to and in alignment with the guide slit for receiving and guiding said light-blocking member as said light-blocking member slides through said sensor groove;

a home position light detecting sensor and a back position light detecting sensor provided in the sensor groove such that said light-blocking member blocks light from reaching said back position light detecting sensor when said cleaning member is at the home end of said charge line and for blocking light from reaching said home position light detecting sensor when said cleaning member is at said opposite end of said charge line and coupled to said control logic, the control logic producing an electric signal for rotating the driving motor clockwise or counterclockwise in response to the position of said cleaning member as indicated by signals detected by said control logic from said home position light detecting sensor and said back position light detecting sensor such that said cleaning member makes a complete sweep from said home end of said charge line to said opposite end of said charge line and back to said home end of said charge line, said control logic sensing the position of said cleaning member solely from signals from said home position light detecting sensor and said back position light detecting sensor.

2. An apparatus according to claim 1, wherein said home position and back position light detecting sensors are located at said home and opposite ends of said charge line, respectively, and wherein the distance between the cleaning member and the light-blocking member is the same as the distance between the home position light detecting sensor and the back position light detecting sensor, the home and back position light detecting sensors being disposed such that when the light-blocking member blocks light from reaching one of the sensors, the other sensor senses light and generates a signal indicating that the location of said cleaning member is adjacent to the end of said charge line at which is located said sensor which is sensing light.

3. An apparatus according to claim 1, wherein the sensor groove extends in the same direction as the guide slit, the sensor groove being opened at opposite sides thereof.

4. An apparatus according to claim 1, wherein the cleaning member is a thin strap of flexible material which can be folded around said charge line and has an inner middle face which is folded around said charge line and has folding recesses in said inner middle face, and has a wire or belt engaging portion for attaching said cleaning member to said upper portion of said wire or belt, and has cleaning pads attached to said folding recesses for wrapping around and brushing off said charge line.

5. An apparatus according to claim 4, wherein the width of the wire or belt engaging portion is the same as or smaller than the width of the cleaning pads.

* * * * *